US007316470B2

(12) United States Patent
Nishi et al.

(10) Patent No.: US 7,316,470 B2
(45) Date of Patent: Jan. 8, 2008

(54) INKJET RECORDING HEAD

(75) Inventors: Shin-ichi Nishi, Hachioji (JP); Katsuaki Komatsu, Hachioji (JP); Kazuo Asano, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 11/347,680

(22) Filed: Feb. 3, 2006

(65) Prior Publication Data

US 2006/0125886 A1 Jun. 15, 2006

Related U.S. Application Data

(62) Division of application No. 10/657,402, filed on Sep. 8, 2003, now abandoned.

(30) Foreign Application Priority Data

Sep. 12, 2002 (JP) ..... 2002-267308

(51) Int. Cl.
*B41J 2/045* (2006.01)

(52) U.S. Cl. ..... 347/69

(58) Field of Classification Search ..... 347/68–72
See application file for complete search history.

(56) References Cited

U.S. PATENT DOCUMENTS 3,748,439 A 7/1973 Ting et al.
4,296,421 A 10/1981 Hara et al.
4,831,390 A * 5/1989 Deshpande et al. ..... 347/18
5,133,403 A 7/1992 Yokono et al.
5,895,973 A 4/1999 Fessenden
5,914,739 A * 6/1999 Zhang ..... 347/71
6,568,797 B2 * 5/2003 Yamauchi et al. ..... 347/70
6,575,551 B2 * 6/2003 Watanabe ..... 347/19

FOREIGN PATENT DOCUMENTS

JP 10-217454 8/1998
JP 2000-135788 5/2000
JP 2001-150680 6/2001
WO WO 01/60627 A2 8/2001

* cited by examiner

*Primary Examiner*—Stephen Meier
*Assistant Examiner*—Geoffrey S. Mruk
(74) *Attorney, Agent, or Firm*—Cantor Colburn LLP

(57) ABSTRACT

An inkjet recording head for ejecting ink in ink channels by deformation of the piezoelectric element, comprising: a partition wall, formed by making grooves in an actuator substrate made of a polarized piezoelectric element, for forming longitudinal side surface of a plurality of ink channels; a cover plate adhered on an upper surface of the partition wall to form a top surface of the plurality of ink channels; a nozzle plate, adhered on a front side surface of the actuator substrate, having a nozzle hole for ejecting ink, wherein the cover plate is made of a machinable ceramics, which has a higher thermal conductivity than that of the piezoelectric element, and where Lc and Lp respectively represent the linear thermal expansion coefficient of the cover plate and the piezoelectric element, the relationship of, $|Lc-Lp| \leqq 5\times10^{-6}/°$ C. is satisfied, and a top plate having higher thermal conductivity than the cover plate is provided on the cover plate.

9 Claims, 2 Drawing Sheets

INKJET RECORDING HEAD

CROSS REFERENCE TO RELATED APPLICATIONS

The present application is a divisional application of U.S. patent application Ser. No. 10/657,402, filed on Sep. 8, 2003 now abandoned, the entire contents of which are incorporated herein by reference. The Ser. No. 10/657,402 application claimed the benefit of the date of the earlier filed Japanese Patent Application No. JP 2002-267308 filed Sep. 12, 2002 priority to which is also claimed herein.

BACKGROUND OF THE INVENTION

The present invention relates to an inkjet recording head with a simple structure that can solve the problems caused by a decrease of ink viscosity by dissipating the drive heat generated during ink ejection, which occurs during high speed drive of the recording head. (PRIOR ART)

Conventionally, a so-called shear mode type inkjet recording head (hereinafter, referred as a shear-mode head) is known in the industry, in which an actuator substrate is structured with a plurality of grooves on a polarized piezoelectric element, a plurality of pressure generation rooms partitioned by said piezoelectric element are formed by adhering a cover plate onto the upper surface of said actuator substrate, said piezoelectric element is deformed by applying an electric voltage between the adjacent pressure generation rooms, and ink is ejected from nozzle holes provided in a nozzle plate.

In this shear-mode head, since ink channels to be filled with ink are formed in the piezoelectric element, when the piezoelectric element generates heat, this heat is transferred to and heats the ink. If the temperature of the ink is raised by heating, the viscosity of the ink is reduced and ink ejection speed increases and the landing position of the ink tends to deviate from the targeted position to cause significant degradation of image quality.

For this reason, in the shear-mode head, without employing a positive heat dissipating measure, or with an insufficient heat dissipating measure, the heat generated in the piezoelectric element has no root of dissipation, and since the heat is transferred to the ink, the viscosity of the ink decreases, the ejection speed of ink drops increases and this causes landing position errors with regard to the recording medium moving at constant rate, and resulting in degradation of image quality.

This heat generation phenomenon affects sensitively the image quality. For example, when ink drops of 20 pl are continually ejected for 2 sec by the drive voltage of 20 V, at a frequency of 17 kHz—this condition can be expressed more specifically based on an actual case—when an ink head carriage moves and prints reciprocally between the edges of a 1350 mm wide width recording medium, with the rate of 600 mm/sec, for the printing of one onward way or homeward way it takes about 2 sec., in this condition, the ink ejection speed at the end of 2 sec. of ejection increases more than 0.1 m/sec compared to the start of the ejection, and the printed image density varies more than 0.01. This is due to heat generation of the head, heat transfer to the ink and decrease of the ink viscosity.

During the time when ink ejection stops for switching the ink carriage moving direction from onward to home ward, the temperature of the head decreases, and after switching the direction, printing is again conducted resulting in variation of image density of more than 0.01 between the start and end of printing. A density difference of 0.01 seems to be a rather small value, however, this density difference appears at adjacent positions in the right and left end of the wide-width recording medium, and this density variation can be visible to the naked eye. In order to make this density variation invisible to the naked eye, it is necessary to reduce the ink ejection speed raise due to heat generation of the head to less than 0.1 m/sec., and to reduce the density variation to less than 0.01, during 2 sec. of continuous ink ejection.

The raising rate of the ink ejection speed increase with respect to the ink temperature increase varies between low viscosity ink and high viscosity ink. For example, as for the high viscosity ink having the viscosity of 10 cp at room temperature, it is known that the ink ejecting speed increases 0.3 m/sec. for every 1° C. temperature raise. Therefore, in cases where a wide-width recording medium is printed from edge to edge of the width, the ink temperature increase in the head is necessary to be restricted within 0.3° C. If ink ejection is continued for a long time, the heat accumulated in the piezoelectric element is transferred to the ink, and the ink temperature gradually increases. Usually, a head is structured such that a thermistor is provided on the head which detects the ink temperature to control the drive voltage of the head to keep the ink ejecting speed constant, however, there are about 10 seconds delay for its response, and this can not adequately respond to the temperature increase which occurs during one line of printing with not more than 10 sec.

Although, temperature increase of the head by the continuous ink ejection during one line printing with about 2 seconds for wide-width recording medium is expected to be rather small, the preferable countermeasure for preventing the temperature increase during such a short time is to improve dissipation of the head to prevent the heat generated in the piezoelectric element from flowing toward the ink.

In the prior art, the technologies are known in which a drive circuit IC is incorporated inside a high heat-conductive and electrically insulative ceramic board to dissipate the heat generated by the IC (refer to patent article 1), and other technology in which a heat generating element is adhered on to a high heat-conductive board by a high heat-conductive film adhesion tape (refer to patent article 2) are known.

However, only a countermeasure such that the member contacting the piezoelectric element is constituted with high heat-conductive material for dissipating the heat of the piezoelectric element is not sufficient to overcome the following problems.

Namely, since in the shear-mode head, ink ejection amount and ink ejection frequency are largely determined by the length of the ink channel, in order to eject sufficiently small ink drops at high frequency, it is necessary to make the length of ink channel not more than 5 mm. For this reason, a piezoelectric member with a length of several cm is necessary to be cut out to make prescribed length of the members, after the member is ground to form grooves, electrodes are formed, and a cover plate is adhered onto the top surface of the formed ink channels. In cases where physical properties of the piezoelectric element and that of the cover plate are greatly different with each other, for example, in the case of ceramics material harder than the piezoelectric element being used for the cover plate, if grinding conditions are set based on the harder ceramics material, the piezoelectric element, which is a less hard material, can be excessively ground resulting in excessively large grooves for ink channels. On the contrary, if the grinding conditions are set based on the piezoelectric element of less hard material, the harder cover plate material cannot be cut well enough. Since a nozzle plate is adhered on this cut surface, forming a nozzle for ejecting ink, if the cut surface is rugged the nozzle plate cannot keep a flat surface and this results in the problem of deflecting the ink ejection direction from the nozzle.

For this reason it is required to adhere the nozzle plate only after the cut surface of the piezoelectric element is polished and smoothed. The polishing requires a considerably long time and is a troublesome process, and further, can lead to problems of clogging and contamination in the ink flow path during the process.

For the piezoelectric element, PZT is frequently used. Since PZT has a Young's modulus of about 50 Gpa, which is a rather small value for ceramics, if it is ground with a diamond cutter, a smooth ground cut surface can be obtained. Other popular ceramics, alumina for example, has a high Young's modulus of about 300-400 Gpa, therefore, the member obtained by adhering the PZT and the alumina is difficult to cut by grinding, and a smooth cut surface cannot be obtained, which requires an additional time consuming process to polish the cut surface.

As for the cover plate, using the same material as the piezoelectric element is preferable from the viewpoints that thermal expansion does not need to be considered and a smooth cut surface can be obtained. However, the piezoelectric element, for example, consisting of PZT has a low thermal conductivity of 1.5-2.0 W/mK, and the heat generated inside the piezoelectric element is hard to dissipate. Namely, if the same material as the piezoelectric element is used for the cover plate, the ink channels are enclosed with materials of low thermal conductivity, so the heat generated in the piezoelectric element is hard to dissipate, which eventually leads to the increase of ink temperature.

Further it is known to use a ceramics with high thermal conductivity as the cover plate covering the upper surface of the ink channels made on the piezoelectric element, and to adhere them with an adhesive with high thermal conductivity (refer to patent article 3), however, said problems regarding the grinding process are not mentioned in the prior art.

Patent article 1: TOKKAI-HEI NO. 10-217454 patent article 2: TOKKAI NO. 2001-150680

Patent article 3: TOKKAI NO. 2000-135788

The objective of the present invention is to improve heat dissipation from the piezoelectric element by using a material with higher thermal conductivity than the piezoelectric element as the cover plate, and to prevent deformation or separation of the inkjet head which used to occur during the use of the head or in the manufacturing process, by using materials having a similar thermal expansion coefficient with the piezoelectric element, and further to provide an inkjet head of high reliability, which does not require in its manufacturing process to polish the ground cut surface of the member constituted by adhesion of the piezoelectric element and the cover plate.

SUMMARY OF THE INVENTION

The above-described objectives are attained by the following features.

An inkjet recording head for ejecting ink in ink channels by deformation of the piezoelectric element, comprising: a partition wall, at least a part of which is formed with a piezoelectric element, for partitioning a plurality of tubular ink channels; a top wall for forming a top surface of the plurality of tubular ink channels by shielding an upper part of the plurality of tubular ink channels; and a bottom wall for forming a bottom surface of the plurality of tubular ink channels by shielding the bottom part of the plurality of tubular ink channels; wherein, at least a part of the top wall and the bottom wall is made of AlN-BN.

An inkjet recording head for ejecting ink in ink channels by deformation of the piezoelectric element, comprising: a partition wall for partitioning the plurality of tubular ink channels; a top wall for forming a top surface of a plurality of tubular ink channels by shielding an upper part of the plurality of tubular ink channels; and a bottom wall for forming a bottom surface of the plurality of tubular ink channels by shielding the bottom part of the plurality of tubular ink channels; wherein, at least a part of the top wall and the bottom wall is formed of a piezoelectric element, and at least a part of the top wall and/or the bottom wall is made of AlN-BN.

The inkjet recording head according to (1) or (2), wherein the part of the top wall and the bottom wall made of AlN-BN is thermally connected to a heat sink.

The inkjet recording head according to (3), wherein the part of the top wall and/or the bottom wall made of AlN-BN is adhered to the heat sink via an epoxy type adhesive agent including Ag particles.

The inkjet recording head according to (4), wherein a layer thickness of the epoxy type adhesive agent is 50 to 70 μm.

The inkjet recording head according to (3), wherein a thickness of the heat sink is 1.0 to 10.0 mm.

The inkjet recording head of according to (1), wherein the part of the top wall and the bottom wall made of AlN-BN is adhered to the partition wall via an epoxy type adhesive agent including particles of one of aluminum-nitride, alumina and silica.

The inkjet recording head of according to (2), wherein the partition wall is formed of AlN-BN, and the partition wall is adhered to the part of the top wall and the bottom wall formed of a piezoelectric element, via an epoxy type adhesive agent including particles of one of aluminum-nitride, alumina and silica.

The inkjet recording head according to (7) or (8), wherein a layer thickness of the epoxy type adhesive agent including particles of one of aluminum-nitride, alumina and silica is 5 to 10 μm.

The inkjet recording head according to (3), wherein the heat sink is provided on a carriage, on which the inkjet recording head is installed.

The inkjet recording head according to (3) or (4), wherein the heat sink is thermally connected to a carriage, on which the inkjet recording head is installed.

Further, the above-described objectives are attained by the following features.

(101) An inkjet recording head, in which an actuator substrate is structured by forming a plurality of grooves on a polarized piezoelectric element, a plurality of pressure generation rooms (ink channels) partitioned with said piezoelectric element (partition wall) are formed by adhering a cover plate onto the upper surface of said actuator substrate, and said piezoelectric element is deformed by applying an electric voltage onto the piezoelectric elements provided between adjacent pressure generation rooms, for ejecting ink from nozzle holes made in a nozzle plate; the inkjet head is characterized in that the cover plate is made of a machinable ceramics, which has a higher thermal conductivity than that of the piezoelectric element, and when Lc and Lp respectively represent the linear thermal expansion coefficient of the cover plate and the piezoelectric element, the relationship of, $$|Lc-Lp| \leqq 5\times10^{-6}/^{\circ}\text{ C. is satisfied, and}$$

a top plate having higher thermal conductivity than the cover plate is provided on the cover plate.

(102) The inkjet recording head of feature (101), characterized in that the Young's modulus of the cover plate is 50-200 GPa.

(103) The inkjet recording head of features (101) or (102), characterized in that the flexural strength of the cover plate is not less than 100 Mpa.

(104) The inkjet recording head of features (101), (102), or (103) characterized in that the Vickers hardness is not greater than 5.0 GPa.

(105) The inkjet recording head of any one of features (101) to (104), characterized in that the dielectric constant ($\epsilon$) of the cover plate is not greater than 100.

(106) The inkjet recording head of any one of features (101) to (105), characterized in that the top plate is a support member for mounting the recording head onto a carriage.

(107) The inkjet recording head of feature (106), characterized in that the thickness of the top plate is 1.0-10.0 mm.

(108) The inkjet recording head of any one of features (101) to (107), characterized in that the adhesive agent used for adhering the cover plate and the top plate comprises epoxy adhesive added with Ag particles.

(109) The inkjet recording head of any one of features (101) to (108), characterized in that the adhesive agent used for adhering the cover plate and the piezoelectric element comprises epoxy adhesive added with aluminum nitride, alumina, or silica.

(110) The inkjet recording head of any one of features (101) to (109), characterized in that the thickness of the adhesive layer between the top plate and the cover plate is 50-70 μm, and the thickness of the adhesive layer between the piezoelectric element and the cover plate is 5-10 μm.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
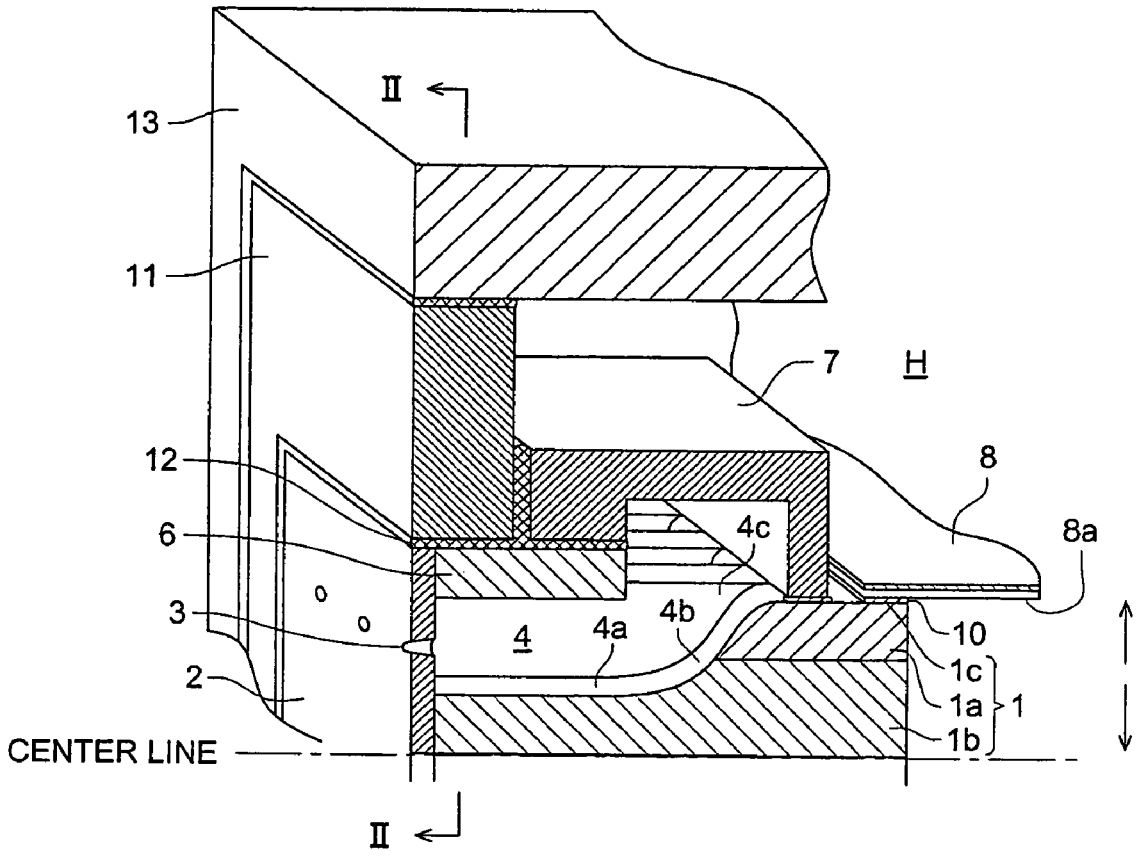
FIG. 1 is an elevational sectional view showing one example of the inkjet recording head of the present invention.

Hereinafter, embodiments of the present invention will be explained referring to the drawings.

Figure 2:
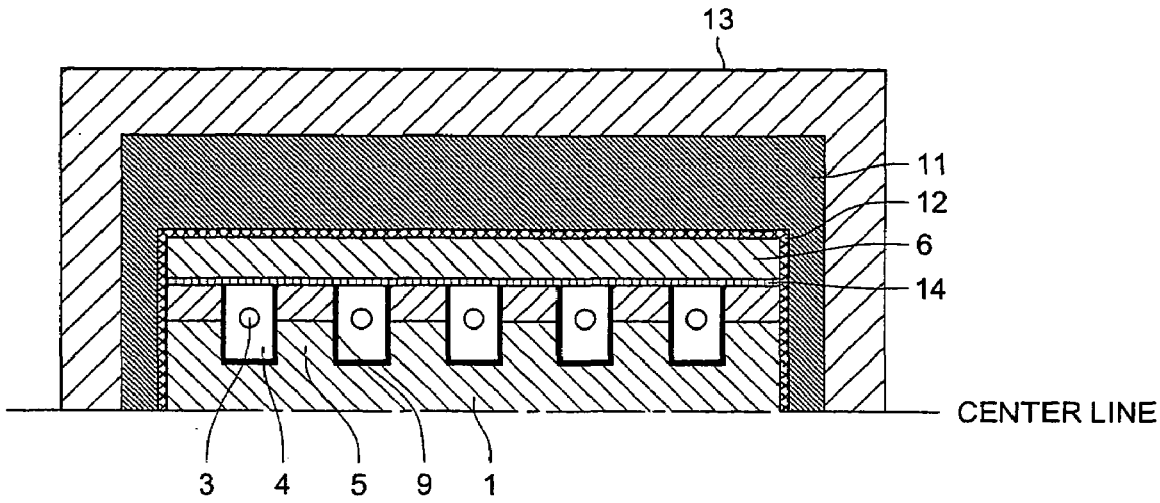
FIG. 2 is a sectional view taken along the line II-II of FIG. 1.

FIG. 1 is an elevational section view showing one example of the inkjet recording head of the present invention, and FIG. 2 is a sectional view taken along the line II-II of FIG. 1.

In FIGS. 1 and 2, H denotes a recording head, 1 denotes an actuator substrate, 2 denotes a nozzle plate, 3 denotes nozzle holes, 4 denotes ink channels as pressure generation rooms, 5 denotes side walls, 6 denotes a cover plate, 7 denotes a manifold, and 8 denotes a FPC (Flexible Print Circuit) board.

Incidentally, the recording head shown in the embodiment is structured such that two of actuator substrate 1 are adhered back to back to each other by displacing a half distance of the nozzle pitch, to form semi-symmetrical configuration about the center line shown by a dashed line in FIGS. 1 and 2. By this structure, without changing the head width, number of the nozzles are increased to twice and nozzle density is also increased to twice.

Actuator 1 is structured by adhering through adhesive agent two piezoelectric elements 1*a* and 1*b* polarized in different direction, and is subjected to a grinding work with diamond blades, etc. from the upper side of piezoelectric element 1*a* to form plural grooved ink channels 4 of the same shape and parallel to each other. By this structure, adjoining ink channels 4 are partitioned with side walls 5 polarized in the direction of the arrows in FIG. 1. Further, ink channel 4 has deep groove portion 4*a*, which is positioned near the exit (left side in FIG. 1) of the ink channel of actuator substrate 1, and shallow groove portion 4*b*, whose depth gradually decreases from deep groove portion 4*a* toward the entrance side of the ink channel (right side in FIG. 1).

Materials used for piezoelectric elements 1*a* and 1*b* are not specially restricted only if the material deforms by application of a voltage, and any commonly known materials such as a board consisting of an organic material can be used, however, a board consisting of piezoelectric nonmetallic material is preferably used. As for the piezoelectric nonmetallic board, there are for example ceramics board formed through the processes of molding and sintering, or a board formed without the need of molding or sintering. As for the organic material, an organic polymer and a hybrid material of organic polymer and inorganic material are listed.

Regarding the ceramic board, there are PZT ($PbZrO_3$—$PbTiO_3$) and PZT added with a third component. As for the third component, there are Pb $(Mg_{1/3}Nb_{2/3})O_3$, Pb $(Mn_{1/3}Sb_{2/3})O_3$, and Pb $(Co_{1/3}Nb_{2/3})O_3$, etc. and further the ceramic board can be formed by using $BaTiO_3$, ZnO, $LiNbO_3$, and $LiTaO_3$, etc.

Regarding the board formed without the need of molding or sintering, it can be formed for example by sol-gel processing or laminated substrate coating. According to the sol-gel processing, "sol" is adjusted through chemical reactions such as hydrolysis generated by adding water, acid or alkalis into a homogeneous solution having a prescribed chemical composition. Further, by subjecting the "sol" to a process such as solvent vaporization or cooling, "sol" dispersed with fine particles of the aimed composition or a precurser of nonmetallic inorganic fine particles is formed and a board can be made from it. Including a process of adding a minute amount of different elements, a chemical compound having uniform chemical components can be obtained by this sol-gel processing. As a starting material, in general, a water soluble metallic salt such as sodium silicate or metallic alkoxide is used. The metallic alkoxide is a compound expressed by general formula M(OR)n, and having a strong basic property due to the OR group, it is easily hydrolyzed to a metal oxide or its hydrate through a condensation process, similar to an organic polymer.

Regarding the laminated substrate coating, there is a method for depositing from a gaseous phase, and methods for forming a ceramic board are classified into two types, a physical evaporation method type and a chemical reaction method type in a gaseous phase or on the surface of the substrate. Further, the physical evaporation method (PVD) type is segmented into vacuum evaporation, spattering, and ion-plating methods, etc., and the chemical reaction method type is segmented into a gaseous phase chemical reaction method (CVD) and a plasma CVD method etc. The vacuum evaporation method as the physical evaporation method (PVD) is a method of depositing vapor onto a substrate by heating and evaporating a subject material in a vacuum chamber. A spattering method is the method of utilizing the phenomenon that when high energy particles collide with a target material to transfer motion energy from the collision particles to atoms/molecules on the target surface to make them sputtered. The ion-plating method is a method of evaporating in an ionized gas atmosphere. In a CVD method, atoms, molecules or compounds including ions, which are to compose the deposition layer, are made to be in gaseous phase, and lead to a reaction zone by an appropriate carrier gas for reaction or deposition on a heated substrate to form a deposition layer. In a plasma-CVD method, a gaseous phase is generated by plasma energy, and a deposition layer is formed by a gaseous phase chemical reaction at a relatively low temperature of 400-500° C.

On the upper surface of actuator substrate 1, cover plate 6 is adhered via an adhesive agent to cover deep groove portions 4*a* of all ink channels 4, and on each shallow groove portions 4*b*, ink inlet 4*c* into ink channel 4 is formed, and manifold 7 is adhered to cover this ink inlet 4*c* via an adhesive agent. Further, at the front edge surface of actuator substrate 1, on which cover plate 6 is adhered, nozzle plate 2 having nozzle hole 3 is adhered via an adhesive agent.

In each ink channel 4, metal electrodes 9 are formed through on both side walls to on the bottom wall, and these metal electrodes extend through shallow groove portion to the upper surface 1*c* in the rear portion of actuator substrate 1. On each of metal electrodes 9, FPC 8 is adhered via ACF (Anisotropic Conductive Film) 10 on the upper surface 1*c* at the rear portion of actuator substrate 1. By applying a drive voltage onto each metal electrode 9 from a drive circuit (not illustrated) through electrodes 8*a* formed on the back surface of FPC8, side walls 5 are shear-deformed, and by the pressure generated by the side wall deformation, ink in ink channel 4 is ejected from nozzle hole 3 formed in nozzle plate 2.

As for metal electrodes 9, metals such as platinum, gold, silver, copper, aluminum, palladium, nickel, tantalum, and titanium can be used, and especially from the viewpoint of electrical characteristics and workability, gold, aluminum, copper, and nickel are preferably used to form metal electrodes 9 employing a plating, evaporation or spattering process. Above all, electroless plating is preferable. The piezoelectric element is structured of particles having a diameter of several μm, and the surface is formed rough, so that uniform electrodes cannot be formed on it by a slanted evaporation process using aluminum, and the drive voltage in this case tends to be increased. On the other hand, by employing electroless plating, since metal is precipitated uniformly along the base surface to form uniform electrodes, the drive voltage can be lowered compared to the case of evaporation. For this electroless plating nickel is preferably used.

The present invention is characterized in that cover plate 6, which directly contacts actuator substrate 1, is made of machinable ceramics having higher thermal conductivity than piezoelectric elements 1*a* and 1*b*, and having linear expansion coefficient Lc, which satisfies the relationship of $|Lc-Lp| \leqq 5\times10^{-6}/°$ C. where Lp represents the linear expansion coefficient of piezoelectric elements 1*a* and 1*b*. Further on said cover plate 6, top plate 11, having higher thermal conductivity than cover plate 6, is provided.

Regarding cover plate 6, by using a material of higher thermal conductivity than piezoelectric elements 1*a* and 1*b*, the heat generated in said piezoelectric elements can be transferred to cover plate 6, and the temperature raise of ink in ink channel 4 can be decreased. For example, in the case where PZT is used for piezoelectric elements 1*a* and 1*b*, since the thermal conductivity of PZT is 1.5-2.0 W/mK, machinable ceramics having higher thermal conductivity than this can be used. The thermal conductivity of cover plate 6 is preferably higher than that of piezoelectric elements 1*a* and 1*b* by at least 5 W/mK, and more preferably by at least 10 W/mK and most preferably by at least 50 W/mK.

The machinable ceramics is generally called free-machining ceramics, and is the ceramics which is easily machined. Generally, ceramics have extremely bad workability, and even when a costly diamond cutter is used, working efficiency remains extremely low and results in the disadvantage of high manufacturing cost. However, the machinable ceramics can be machined by machining apparatuses and tools for usual metal machining.

Of the machinable ceramics, there are mica-glass ceramics and aluminum nitride, in which numerous minute cracks exist. The mica-glass ceramics have a structure such that crystallites of fluorinated mica are precipitated in three-dimension and in a disarrayed state in a glassy matrix. When the edge of a grinding tool cuts into this ceramics, the mica crystallites are broken by priority, the breakages are held to within a restricted area, and minute swarf particles are ejected. As for concrete examples of the mica-glass ceramics, there are "Macor" made by Corning Glass Works Incorporated, and "Photoveel II" made by SUMIKIN CERAMICS & QUARTZ Co., Ltd.

Aluminum nitride is a type of ceramics, which generates numerous interior minute cracks, featuring excellent workability, and is especially preferable due to its sufficiently high thermal conductivity. Specifically, AlN-BN (Aluminumnitride-Boronnitride) composed of at least 70 mol % of Aluminum and less than 30 mol % of Boron is preferable. Specifically, there are AlN-BN made by SUMIKIN CERAMICS & QUARTZ Co., Ltd, and "Sapal Msoft" made by TOKUYAMA Corp.

Further, a $MgO—SiO_2$ type mica ceramics, there is a "FORSTERITE" made by Kyocera Corporation.

The machinable ceramics to be used for cover plate 6 necessarily have the linear expansion coefficient Lc, which satisfies the relationship of $|Lc-Lp| \leqq 5\times10^{-6}/°$ C. where Lp represents the linear expansion coefficient of piezoelectric elements 1*a* and 1*b*. Namely it is preferable for the cover plate to have a near value of a linear expansion coefficient as that of piezoelectric elements 1*a* and 1*b*. The reason for this is that if the linear expansion coefficient of cover plate 6 is far different from that of piezoelectric elements 1*a* and 1*b*, when cover plate 6 is adhered to actuator substrate 1 by using thermoset type adhesive agent, deformation can result during cooling leading to separation between materials. Further, by satisfying the above-mentioned relationship, the occurrence of the similar deformation or separation as that mentioned above, which can be caused by the heat generated in piezoelectric elements 1*a* and 1*b* can be prevented. More preferably, the relationship of $|Lc-Lp| \leqq 3\times10^{-6}/°$ C. is satisfied.

The values of thermal conductivity w (W/mK) and linear expansion coefficient Lc of the machinable ceramics shown as examples above are:

AlN-BN made by SUMIKIN CERAMICS & QUARTZ Co., Ltd : W=90, Lc=4.9 (room temperature to 500° C.), "Sapal Msoft" made by TOKUYAMA Corp.: W=90, Lc=4.4, "Photoveel II" made by SUMIKIN CERAMICS & QUARTZ Co., Ltd: W=19.5, Lc=1.4, "FORSTERITE" made by Kyocera Corporation: W=7.8, Lc=10.5.

Each of these materials has a higher thermal conductivity than the PZT (W=1.5, Lp=5) preferably used for the piezoelectric elements, and satisfies the above relationship of linear expansion coefficient.

On this cover plate 6, top plate 11, whose thermal conductivity is higher than that of cover plate 6, is adhered via adhesive agent 12. This top plate 11 functions as the supporting body for attaching actuator substrate 1 adhered with cover plate 6 onto housing 13 provided in a carriage (not illustrated). Top plate 11 also functions as the guide member while wiping the surface of nozzle plate 2 by being arranged to form approximately the same plane as the surface of nozzle plate 2. By constituting this top plate 11 with a member having higher thermal conductivity than that of cover plate 6, the heat generated in piezoelectric elements 1*a* and 1*b* is easily transferred to cover plate 6, having higher thermal conductivity than piezoelectric elements, and further, by making the heat transfer to top plate 11 having a higher thermal conductivity than cover plate 6, this top plate 11 functions as a so-called heat sink. For this purpose, top plate 11 is preferable to have sufficiently larger surface area than cover plate 6, for ensuring sufficient heat capacity, and is preferable to have a wide contact area with cover plate 6 for ensuring low thermal resistivity. For example, the thickness of top plate 11 in the longitudinal direction of ink channel 4, which is parallel to the contact plane between cover plate 6 and top plate 11, is preferably 1.0-10.0 mm.

Materials having higher thermal conductivity than cover plate 6 are usable for top plate 11, and aluminum (thermal conductivity W=236 W/mK), brass (W=106), copper (W=403), and diecast aluminum (W=90) are preferably used. Above all, aluminum is preferable from the viewpoint of workability and cost.

In order to effectively transfer the heat generated in piezoelectric elements 1*a* and 1*b*, through cover plate 6 into top plate 11, adhesive agent 12 for adhering cover plate 6 and top plate 11 is preferable to have high thermal conductivity. From this viewpoint, regarding adhesive agent 12 for adhering cover plate 6 and top plate 11, it is preferable to add Ag (silver) particles into the epoxy type adhesive agent. Although, epoxy type adhesive agent has extremely low thermal conductivity (0.1-0.3 W/mK), by adding Ag particles, the thermal conductivity of adhesive agent is improved to 3-5 W/mK. Generally, heat transfer resistance Rc of members having a thermal conductivity "k" (W/mK), thickness L (m), area A ($m^2$) is represented by $Rc=L/k\cdot A$ (K/W), therefore, it is preferable to make L as small as possible while making A as large as possible.

For this reason, the thinner the layer thickness of adhesive agent 12, the more preferable it is since the heat transfer resistance decreases. Further the surface of top plate 11 is preferable to be rough for improving thermal dissipation, however, if air bubbles intervene the adhesive layer the thermal transfer resistance becomes very high because of the extremely low thermal conductivity of air, therefore, it is preferable to make the layer thickness of adhesive agent 12 between top plate 11 and cover plate 6 to be 50-70 μm so as to prevent air bubbles from entering.

Further, the thermal conductivity of adhesive agent 14 existing between cover plate 6 and actuator substrate 1 is preferable to have high thermal conductivity. Since this adhesive agent 14 contacts metal electrodes 9, electrical insulation is required of adhesive agent 14, and the adhesive agent made by adding fine particles, having high thermal conductivity, such as AlN, alumina, or silica into epoxy type adhesive agent. Although epoxy type adhesive agents have extremely low thermal conductivity (0.1-0.3 W/mK), by adding ceramic particles of high thermal conductivity such as aluminum nitride (AlN), alumina, or silica particles, the thermal conductivity of adhesive agent 14 is improved (to 0.5-1.0 W/mK in the case of AlN), and the heat in actuator substrate 1 is effectively transferred to cover plate 6. The thickness of the adhesive agent between cover plate 6 and actuator substrate 1 is preferable to be 5-10 μm. If it is thinner than 5 μm, air bubbles are likely to enter into the adhesive layer, and if it is thicker than 10 μm, the deformation efficiency of ink channel 4 decreases.

In the process of adhering cover plate 6 to actuator substrate 1, surface roughness of respective surfaces is important. In the case where the cover plate is formed of Photoveel II, since the adhesive agent is absorbed into minute voids existing in the cover plate, the thickness of the adhesive agent layer after hardening can not maintained, and results in poor adhesive strength. In cases of $Al_2O_3$ and PZT, it is also difficult to obtain an optimum adhering condition, and manufacturing efficiency becomes rather poor.

On the other hand, since AlN-Bn has a dense material structure, small amount of minute voids, large Young's modulus and high hardness, almost all the applied adhesive agent functions as the effective adhesive layer after hardening. Therefore, AlN-BN is a material suitable for the cover plate exhibiting a high manufacturing efficiency.

In the present invention, the dielectric constant ($\epsilon$) of cover plate 6 is preferable to be low. Because the lower the dielectric constant, the less the electric field leakage from piezoelectric elements 1*a* and 1*b*, and the drive voltage can be lowered. If the drive voltage is lowered, the heat generated in piezoelectric elements 1*a* and 1*b* can be decreased. Specifically, the dielectric constant ($\epsilon$) of cover plate 6 is not to be greater than 100, and preferably is not greater than 10. For example dielectric constant ($\epsilon$) of AlN-BN made by SUMIKIN CERAMICS & QUARTS Co., Ltd is: $\epsilon$=7.1, "Photoveel II" made by SUMIKIN CERAMICS & QUARTZ Co., Ltd: $\epsilon$=approx. 6, and "FORSTERITE" made by Kyocera Corporation: $\epsilon$=6.8, these values are extremely small compared to the dielectric constant of PZT ($\epsilon$=2000-4000).

Further, the greater flexural strength of cover plate 6 is the more preferable, specifically, the flexural strength of not less than 100 Mpa is preferable, while not less than 200 Mpa is more preferable. The reason for this is that when actuator substrate 1 is deformed, the smaller the deflection of cover plate 6, the better the ink ejecting efficiency which can be attained. For example, the flexural strength of AlN-BN made by SUMIKIN CERAMICS & QUARTZ Co., Ltd is 294 Mpa, the flexural strength of "Photoveel II" also made by SUMIKIN CERAMICS & QUARTZ Co., Ltd is 440 Mpa. If flexural strength is less than 100 MPa, the ink ejecting efficiency decreases and drive voltage must be increased, which is not preferable.

Furthermore, Young's modulus of cover plate 6 is preferable to be 50-200 GPa. Since the Young's modulus of piezoelectric elements 1*a* and 1*b* is about 50 GPa, if the Young's modulus of cover plate 6 is greater than 50 Gpa, cover plate 6 is not likely to be influenced by the deformation of piezoelectric elements 1*a* and 1*b*, and the ink ejecting efficiency improves. However, if Young's modulus of cover plate 6 is greater than 200 Gpa, machinable characteristics of cover plate 6 lowered and cutting property is degraded.

The Vickers hardness of cover plate 6 is preferable to be not greater than 5.0 GPa. If this exceeds 5.0 Gpa, the grinding property becomes worse, and cover plate 6 cannot be cut finely, and in addition the life of diamond cutters used for machining the plate is shortened.

Further, nozzle plate 2 is also preferable to have a higher thermal conductivity than piezoelectric elements la and lb. Since this nozzle plate is adhered onto the front edge surfaces of actuator substrate 1 and cover plate 6, by making the thermal conductivity of nozzle plate 2 higher than that of piezoelectric elements 1*a* and 1*b*, the heat generated in piezoelectric elements 1*a* and 1*b* can be dissipated from nozzle plate 6 in addition to the dissipation from cover plate 6.

Regarding a material of this nozzle plate 2, the material having a higher thermal conductivity than piezoelectric elements 1*a* and 1*b* can be used. Since resins generally have lower thermal conductivity than the piezoelectric elements, resins are not preferable, but metals are preferable for the material of nozzle plate 2. For example, since the thermal conductivity of stainless steel is 15 W/mK, compared to the thermal conductivity of polyimide resin (0.1-0.2 W/mK), which is commonly used for the nozzle plate material, the heat dissipation effect can be improved by using stainless steel for nozzle plate 2. Above all, Covar or 42-alloy, which have values near the linear expansion coefficient of piezoelectric substrate 1, is preferable for the nozzle plate material.

Embodiments

EXAMPLE 1

On a polarized piezoelectric element "H 5 D" made by Sumitomo Metal Industries, Ltd. (with a thermal conductivity W=1.5 W/mK, and a linear expansion coefficient=$5\times10^{-6}$/° C.), 768 grooves, which are to be ink channels and having a width of 80 μm, a depth of 200 μm, and a length of 60 mm, are formed by using a diamond cutter to form the actuator substrate. Further, nickel electrodes are formed by electroless plating on the side walls in these ink channels.

On the actuator substrate, a cover plate formed of aluminumnitride-boronnitride AlN-BN (made by SUMIKIN CERAMICS & QUARTS Co., Ltd. having a thermal conductivity W=90.0 W/mK, and linear expansion coefficient=$4.9\times10^{-6}$/° C.) is adhered by using a high thermo-conductive epoxy adhesive agent including AlN particles (at a layer thickness of 10 μm, W=1.0 W/mK).

Obtained adhered member is cut with a diamond cutter to form 2.5 mm length ink channels, next, a nozzle plate made of polyimide resin and a manifold are adhered, after which a FPC (Flexible Printed Circuit) is connected to each electrode. On the upper surface of the cover plate, an aluminum top plate (1 mm thick) is adhered by using high thermo-conductive epoxy type resin including Ag particles (with a layer thickness of 50 μm, W=3.0 W/mK).

The recording head structure as described above is attached onto a carriage, and subjected to ejecting ink continuously for 2 seconds. The velocity of ink drops and the density of printed images at the time of starting the ejection and at the end of the ejection are measured.

EXAMPLE 2

As an adhesive agent, a normal epoxy type adhesive agent (W=0.3 W/mK) without added thermo-conductive particles was used. Other conditions were the same as those of Example 1.

EXAMPLE 3

Electrodes are formed of aluminum, as an adhesive agent a normal epoxy type adhesive agent (W=0.3 W/mK) without thermo-conductive particles was used, and a nozzle plate is formed of stainless steel. Other conditions were the same as those of Example 1.

EXAMPLE 4

Electrodes were formed of aluminum, a cover plate formed of "Photoveel II" (W=19.5 W/mK) made by SUMIKIN CERAMICS & QUARTZ Co., Ltd is adhered by using normal epoxy adhesive agent (W=0.3 W/mK) without thermo-conductive particles, and a nozzle plate is formed of stainless steel. Other conditions were the same as those of Example 1.

COMPARATIVE EXAMPLE 1

An alumina ceramics plate (W=33 W/mK) was used for the cover plate, and as an adhesive agent, normal epoxy adhesive agent (W=0.3 W/mK) without thermo-conductive particles was used. Other conditions were the same as those of Example 1.

COMPARATIVE EXAMPLE 2

A depolarized piezoelectric material (PZT: thermal conductivity W=1.5 W/mK) was used for the cover plate, an engineering plastic PEI (polyetherimide: W=0.1 W/mK) was used for the top plate, and as adhesive agent normal epoxy adhesive agent (W=0.3 W/mK) without thermo-conductive particles was used. Other conditions were the same as those of Example 1.

For an image quality evaluation, qualities of the printed images were evaluated by visual observation using the following standard.

A: Without unevenness in the printed image, the image is very crisp.

B: Unevenness in the printed image is not conspicuous, and the image is acceptably crisp.

C: Unevenness in the printed image print is somewhat conspicuous, and the image quality is somewhat degraded.

D: Unevenness in the printed image is conspicuous, and the image quality is poor.

Further, a manufacturing efficiency (or easiness of production) was evaluated for the recording head made in the above examples and comparative examples, using the following standard.

A: Good manufacturing efficiency in the process of machining and adhering, without requiring a polishing work for the ground cut surface of the member constituted of adhered the piezoelectric elements and a cover plate.

C: Somewhat degraded manufacturing efficiency in the process of machining and adhering, requiring a polishing process.

Incidentally, adhesive 1 in Table 1 represents the adhesive agent between the top plate and the cover plate, and adhesive 2 represents the adhesive agent between the cover plate and the piezoelectric substrate.

In Example 1, when inkjet printing was conducted from edge to edge of a 1350 mm wide large-sized recording medium, requiring 2 seconds for edge to edge printing, the print density increase caused by heat generation in the head was 0.005, and unevenness in printing was not observed. Further, when ink channels of predetermined length were formed by cutting with a diamond cutter, the cut surface was clean and crisp did not require a polishing process.

In Example 2, since an adhesive agent with low thermal conductivity was used, the density difference became a little greater compared to Example 1, however it was not detectable by visual observation and there was no practical problem in image quality.

In Example 3, since aluminum was used for electrodes, the drive voltage of the recording head needed to be increased, and the density difference was also increased to some extent, however, it was hardly detected by visual observation, and there was no practical problem in image quality.

In Example 4, since the cover plate was different from that of Example 1, the thermal conductivity was a little lower than in Example 1, and the density difference increased, however, it was hardly detected by visual observation, and there was no practical problem in image quality.

In Comparative Example 1, since $Al_2O_3$, which exhibits poor workability was used for the cover plate, when ink channels of predetermined length were formed by cutting with a diamond cutter, the cut surface was rough, which required a polishing process. Further, since a thermal conductivity of $Al_2O_3$ is less compared to AlN-BN, the density difference became very large and was detectable by visual observation, and the image quality was poor.

In Comparative Example 2, since PZT of low thermal conductivity was used for the cover plate, and PEI with low thermal conductivity was used for the top plate, the density difference was further increased.

Regarding the evaluation of manufacturing efficiency for the recording head, examples 1 to 3, where machinable ceramics are used for the cover plate, showed good efficiency, and other example or comparative example showed somewhat degraded manufacturing efficiency.

Incidentally, adhesive 1 in Table 1 represents the adhesive agent between the top plate and the cover plate, and adhesive 2 represents the adhesive agent between the cover plate and the piezoelectric substrate.

EFFECT OF THE INVENTION

According to the present invention, an inkjet recording head with excellent heat dissipation, with no noticeable density unevenness, exhibiting no deformation or separation, can be provided. And further can be provided an inkjet recording head exhibiting high reliability, which does not need in its manufacturing process a polishing work for the ground cut surface of the member constituted of adhered the piezoelectric elements and a cover plate.

What is claimed is:

1. An inkjet recording head for ejecting ink in ink channels by deformation of the piezoelectric element, comprising:

a partition wall and a bottom wall, respectively formed by making grooves in an actuator substrate made of a polarized piezoelectric element, for forming longitudinal side surface and bottom surface of a plurality of ink channels;

a cover plate adhered on an upper surface of the partition wall to form a top surface opposing to the bottom surface of the plurality of ink channels;

a nozzle plate, adhered on a front side surface of the actuator substrate, having a nozzle hole for ejecting ink, wherein the cover plate is made of a machinable ceramics, which has a higher thermal conductivity than that of the piezoelectric element, and where Lc and Lp respectively represent the linear thermal expansion coefficient of the cover plate and the piezoelectric element, the relationship of, $$|Lc-Lp| \leqq 5 \times 10^{-6}/^{\circ}\text{C. is satisfied, and}$$

a top plate having higher thermal conductivity than the cover plate is adhered with an adhesive agent on the cover plate, wherein a Vickers hardness of the cover plate is not greater than 5.0 GPa.

2. The inkjet recording head of claim 1, wherein a Young's modulus of the cover plate is 50-200 GPa.

3. The inkjet recording head of claim 1, wherein a flexural strength of the cover plate is not less than 100 Mpa.

4. The inkjet recording head of claim 1, wherein a dielectric constant ($\epsilon$) of the cover plate is not greater than 100.

5. The inkjet recording head of claim 1, wherein a top plate is a support member for mounting the recording head onto a carriage.

6. The inkjet recording head of claim 5, wherein a thickness of the top plate is 1.0 to 10.0 mm.

7. The inkjet recording head of claim 1, wherein an adhesive agent used for adhering the cover plate and the top plate comprises epoxy type adhesive agent added with Ag particles.

8. The inkjet recording head of claim 1, wherein an adhesive agent used for adhering the cover plate and the upper surface of the partition wall comprises an epoxy type adhesive agent added with one of aluminum nitride, alumina, or silica.

9. The inkjet recording head of claim 1, wherein a thickness of the adhesive layer between the top plate and the cover plate is 50-70 μm, and a thickness of the adhesive layer between the upper surface of the partition wall and the cover plate is 5-10 μm.

* * * * *